US012349772B2

(12) United States Patent
Shinomiya et al.

(10) Patent No.: US 12,349,772 B2
(45) Date of Patent: Jul. 8, 2025

(54) STOPPER FOR SLIDE FASTENER AND METHOD TO PRODUCE STOPPER FOR SLIDE FASTENER

(71) Applicant: YKK Corporation, Tokyo (JP)

(72) Inventors: Koki Shinomiya, Kurobe (JP); Jun Kiyohara, Kurobe (JP); Masamichi Yamagata, Kurobe (JP); Makoto Yamakoshi, Kurobe (JP); Masashi Oshita, Kurobe (JP); Atsushi Ogihara, Kurobe (JP); Hirofumi Tanikoshi, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 18/562,501

(22) PCT Filed: Jul. 20, 2021

(86) PCT No.: PCT/JP2021/027208
§ 371 (c)(1),
(2) Date: Nov. 20, 2023

(87) PCT Pub. No.: WO2023/002582
PCT Pub. Date: Jan. 26, 2023

(65) Prior Publication Data
US 2024/0245174 A1 Jul. 25, 2024

(51) Int. Cl.
*A44B 19/36* (2006.01)

(52) U.S. Cl.
CPC ..... *A44B 19/36* (2013.01)

(58) Field of Classification Search
CPC ..... A44B 19/36; A44B 19/60; A44B 19/403; A44B 19/406; Y10T 24/2598;
(Continued)

(56) References Cited

U.S. PATENT DOCUMENTS 4,437,210 A * 3/1984 Fukuroi ..... A44B 19/36 24/703.1
5,390,396 A 2/1995 Hirota
(Continued)

FOREIGN PATENT DOCUMENTS

JP S58-98810 U 7/1983
JP H06-034504 U 5/1994
JP 3164407 U 11/2010

OTHER PUBLICATIONS

JP 3164407U English Translation from Espacenet, 6 pages (Year: 2010).*
(Continued)

*Primary Examiner* — Jason W San
*Assistant Examiner* — Louis A Mercado
(74) *Attorney, Agent, or Firm* — Procopio, Cory, Hargreaves & Savitch LLP

(57) ABSTRACT

Provided is a stopper for a slide fastener and a method for manufacturing a stopper for a slide fastener, which can reduce mutual adhesion and defective rates during the painting process. A coated metal stopper for a slide fastener is provided. The stopper includes a head and a pair of legs extending from the head in a bifurcated manner. Each of the legs has a recess in the center on its inner surface. The ratio of the depth of the recess to the thickness of each leg of the stopper is 3.8% or more and 18.9% or less. Further, the ratio of the length of the recess in a longitudinal direction of the stopper to the length of the stopper in the longitudinal direction can be 13.5% or more and 23.5% or less.

8 Claims, 7 Drawing Sheets

(58) Field of Classification Search
CPC ..... Y10T 24/2559; Y10T 24/2557; Y10T 24/255; Y10T 24/2539; Y10T 24/2511; Y10T 24/2532
See application file for complete search history.

(56) References Cited

U.S. PATENT DOCUMENTS

| | | | | |
|---|---|---|---|---|
| 6,634,066 | B2 * | 10/2003 | Okada | A44B 19/386 24/433 |
| 7,082,649 | B2 * | 8/2006 | Aoki | A44B 19/06 24/414 |
| 7,805,817 | B2 * | 10/2010 | Deto | A44B 19/36 24/436 |
| 8,776,330 | B2 * | 7/2014 | Keyaki | A44B 19/36 24/434 |
| D779,374 | S * | 2/2017 | Hamada | D11/221 |
| D780,624 | S * | 3/2017 | Hamada | D11/221 |
| 9,781,981 | B2 * | 10/2017 | Fukuyama | A44B 19/60 |
| 2008/0115337 | A1 * | 5/2008 | Ohgaku | A44B 19/36 24/433 |
| 2011/0209308 | A1 * | 9/2011 | Ostinelli | A44B 19/36 24/436 |

OTHER PUBLICATIONS

International Preliminary Report on Patentability translation received in corresponding International App. No. PCT/JP2021/027208, mailed Feb. 1, 2024, in 5 pages.

* cited by examiner

[FIG. 1]
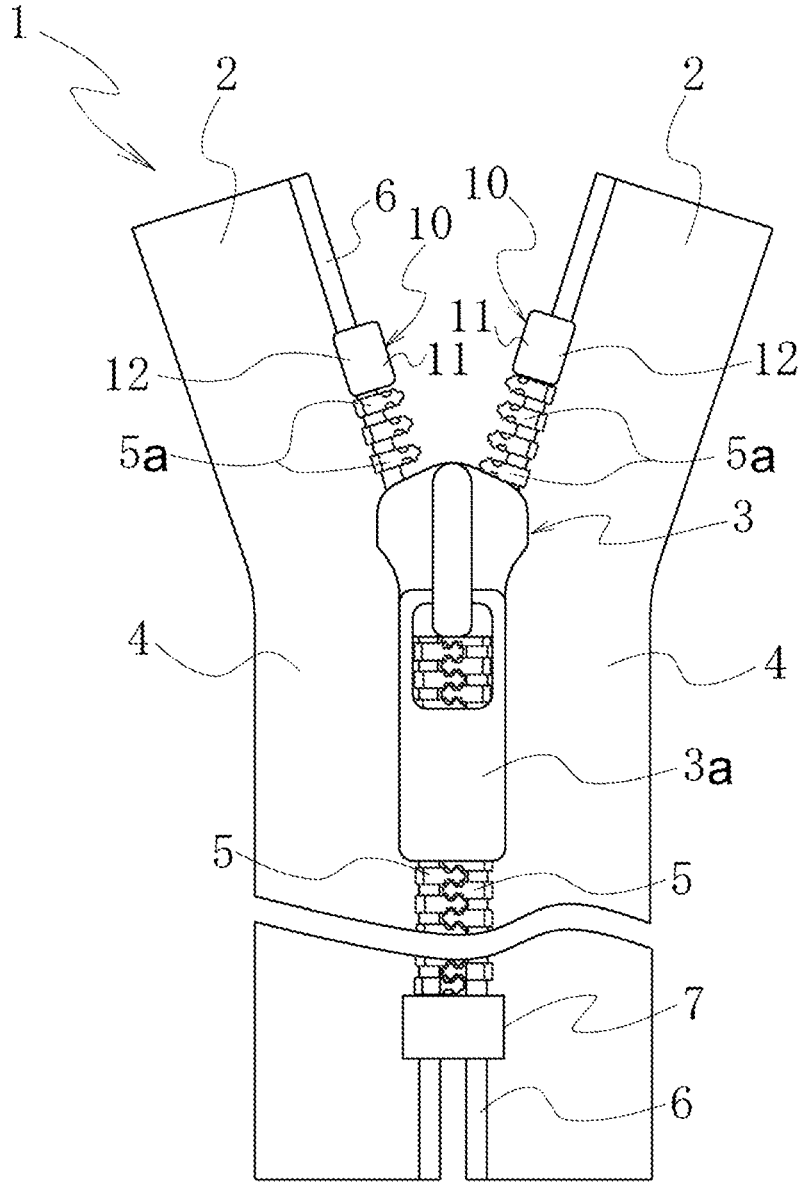

[FIG. 2]
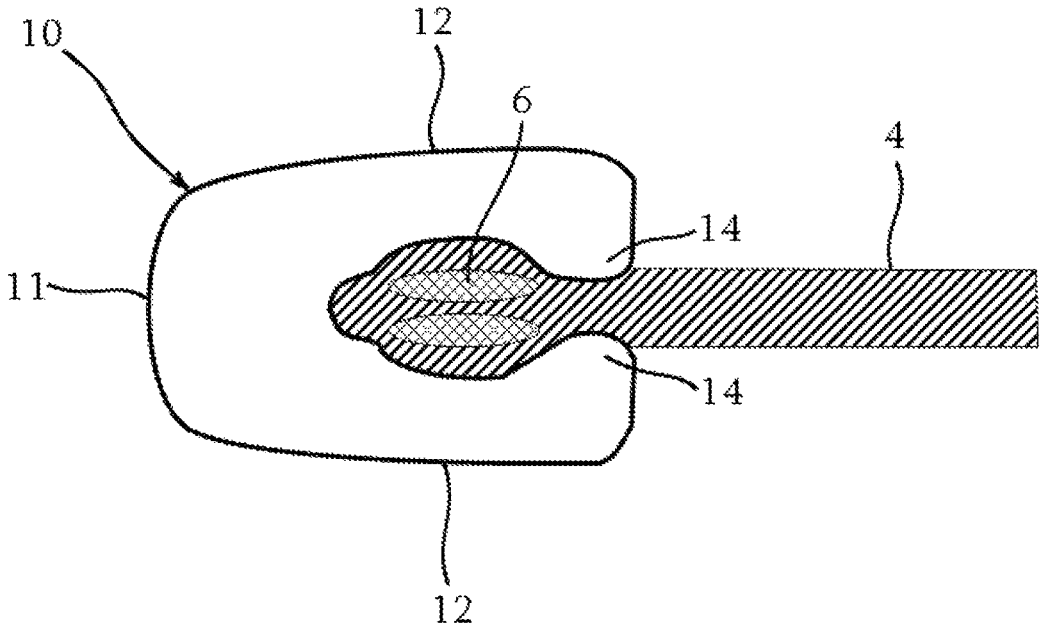

[FIG. 3]
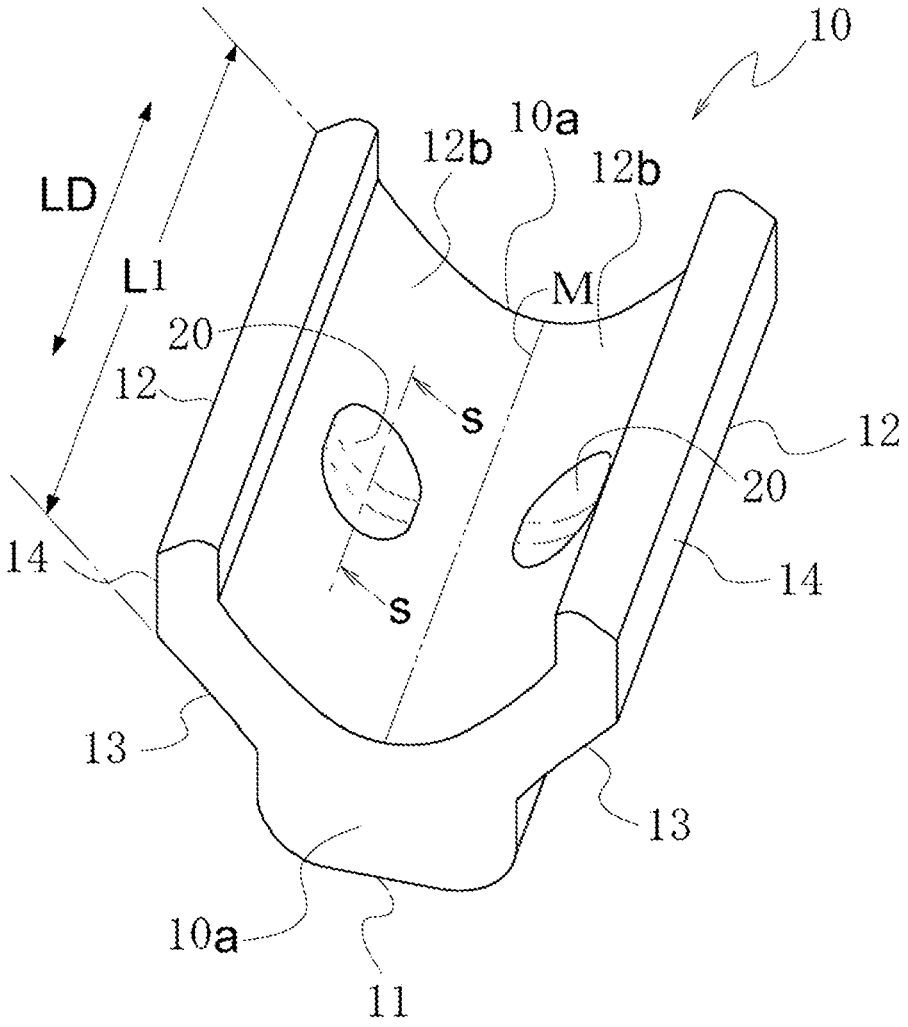

[FIG. 4]
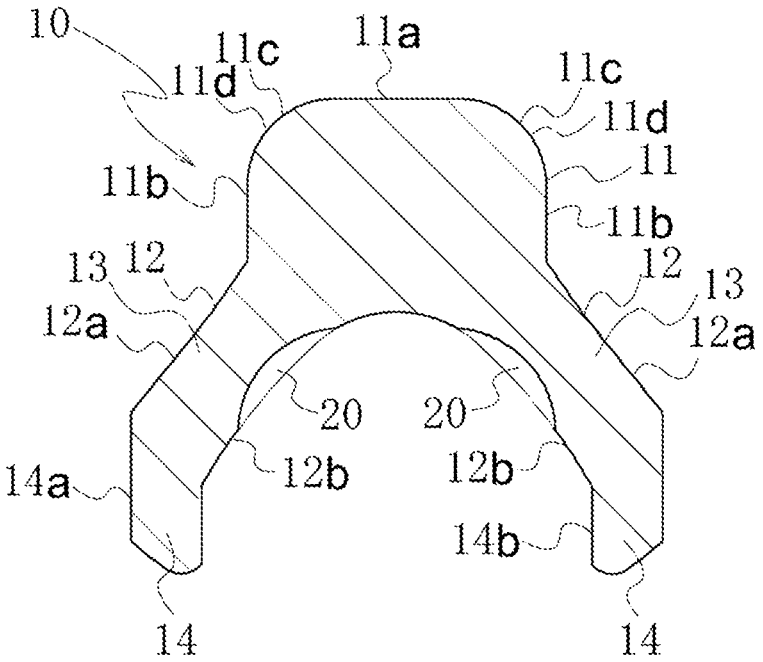

[FIG. 5]
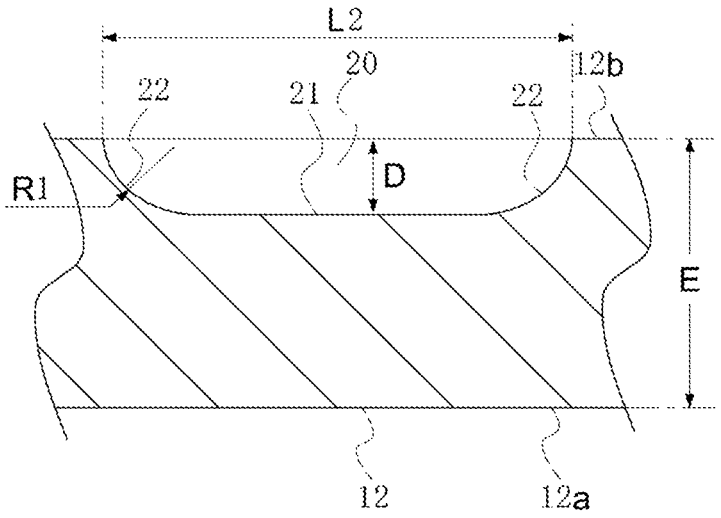

[FIG. 6]
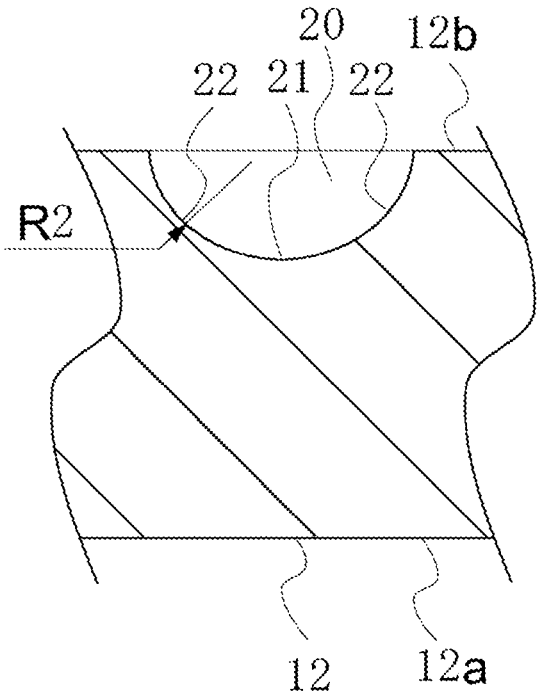

[FIG. 7]
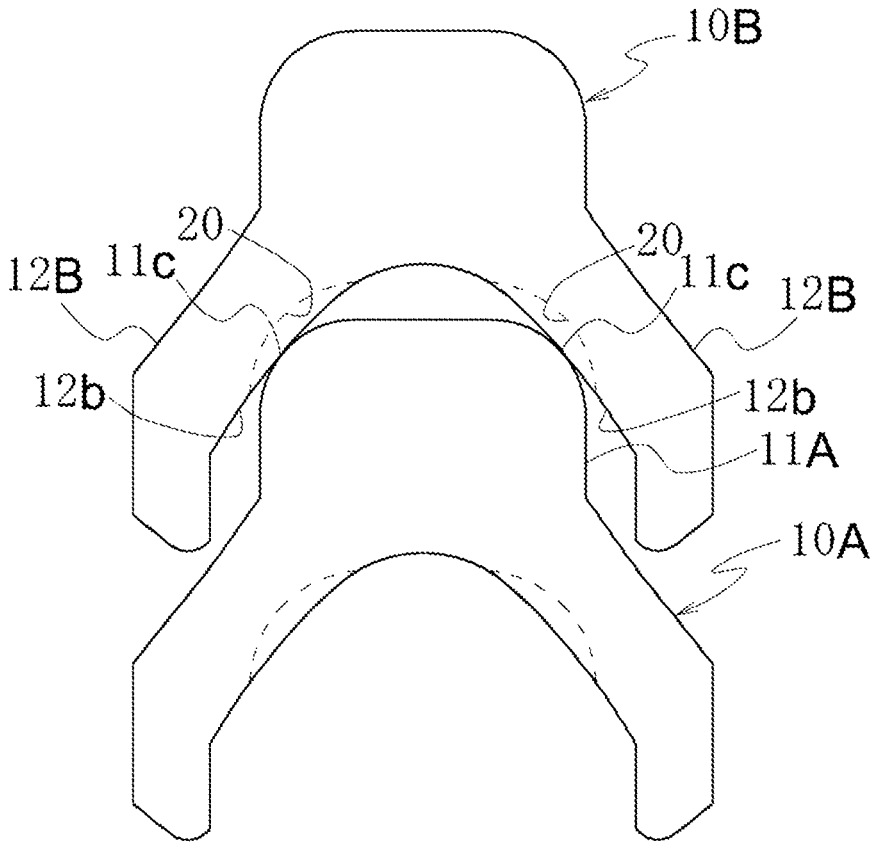

STOPPER FOR SLIDE FASTENER AND METHOD TO PRODUCE STOPPER FOR SLIDE FASTENER

CROSS-REFERENCE TO RELATED APPLICATIONS

This application is a U.S. national stage application of International Application No. PCT/JP2021/027208, filed Jul. 20, 2021, the contents of which are incorporated by reference.

TECHNICAL FIELD

The present invention relates to a stopper for a slide fastener and a method to produce a stopper a slide fastener, and more particularly to a stopper such as an upper stopper for limiting a sliding range of a slider in a slide fastener and to a method for manufacturing the stopper.

BACKGROUND ART

A slide fastener comprises a pair of left and right fastener stringers, a slider for a user to slide to open and close between element rows provided on the opposite edges of fastener tapes of the left and right fastener stringers, and upper stoppers, etc. to limit a sliding range of the slider.

Utility Model Publication No. S58-98810 (Patent Document 1) and Utility Model Registration No. 3164407 (Patent Document 2) disclose a stopper in a state before being attached to a slide fastener. Such a stopper includes a head and a pair of legs protruding from the head in a bifurcated manner. When a stopper is applied to a fastener tape, an opposite edge of the fastener tape is placed between the two legs of the stopper, and then the stopper is crimped so as to close both legs. Thereby, the stopper is fixed to the fastener tape.

A metallic stopper is generally coated before being attached to the fastener tape the fastener. In this coating process, a large number of stoppers are housed in a barrel container, and a coating is sprayed onto the stoppers from outside the barrel container while the barrel container is rotated.

In the above painting process, two of the many stoppers that are moving randomly within the barrel container may overlap each other. Referring to FIG. 7, this is a state wherein a head (11A) of one stopper (10A) comes in between two legs (12B) of the other stopper (10B) and the stoppers overlap. At this time, two head corner portions (11*c*) of the head (11A) of one stopper (10A) are in contact with the inner surfaces (12*b*) of the two legs (12B) of the other stopper (10B). Therefore, there may be cases in which two stoppers adhered to each other through the coating on their contacting portions. Further, uncoated portions may occur because the contacting portions peel off during or after the painting process.

CITATION LIST

Patent Literatures

Patent Document 1: Utility Model Publication No. S58-98810

[Patent Document 2: Utility Model Registration No. 3164407

SUMMARY OF THE INVENTION

Technical Problem

An object of the present invention made in view of the problems as mentioned above is to provide a stopper for a slide fastener and a method for manufacturing a stopper for a slide fastener, which can reduce mutual adhesion and defective rates during the painting process.

Solution to Problem

In order to solve the above-mentioned problems, one aspect of the present invention provides a coated metal stopper for a slide fastener, comprising: a head and a pair of legs extending from the head in a bifurcated manner, wherein each of the legs has a recess in the center on its inner surface; and wherein the ratio of the depth of the recess to the thickness of each leg of the stopper is 3.8% or more and 18.9% or less.

In the present invention, the recess of the stopper is formed before the painting process, and the stopper is attached to a fastener tape after the recess is formed. In the present invention, by providing the recess on the inner surface of each leg of the stopper, even if two stoppers overlap during the painting process, it is possible to reduce an adhesion area between the two stoppers. Thereby, it is possible to reduce a rate of the stoppers becoming defective because both stoppers adhere to each other or uncoated portions occur because the adhesion peels off. In particular, when the ratio of the depth of the recess to the thickness of the leg of the stopper is set to 3.8% or more and 18.9% or less, it is possible to reduce an adhesion area between two stoppers during the painting process. When the above ratio is less than 3.8%, it would not significantly contribute to reducing the adhesion between two stoppers during the coating process. When a recess with the ratio exceeding 18.8% is molded using a concave mold, a convex dent would be noticeable, which is generated at a portion corresponding to the recess, on the outer surface of each leg in the stopper, spoiling the appearance of the stopper.

In one embodiment of the present invention, the ratio of the length of the recess in a longitudinal direction of the stopper to the length of the stopper in the longitudinal direction is 13.5% or more and 23.5% or less. Thereby, it is possible to reduce an adhesion area between both stoppers when they overlap during the painting process. Thus, it is thought to prevent adhering between the two stoppers and therefore to effectively reduce uncolored portions due to the adhesion.

The stopper of the present invention is made of aluminum, aluminum alloy, copper, copper alloy, titanium, titanium alloy, nickel, nickel alloy, magnesium, magnesium alloy, etc., but not limited thereto.

In one embodiment of the present invention, the recess includes, in a cross-section along the longitudinal direction of the stopper, a bottom portion, which is deepest from the inner surface and two corner portions, each of which is concave, curved surface becoming shallower from the bottom portion to the inner surface, wherein a radius of curvature of each corner portion is 0.6 mm or more. Further, in one embodiment of the present invention, the recess includes, in a cross-section along a transverse direction of the stopper, the bottom portion, which is deepest from the inner surface and the two corner portions, each of which is concave, curved surface becoming shallower from the bottom portion to the inner surface, wherein a radius of curvature of each corner portion (22) is 0.6 mm or more. Even when the corner portion is molded so that its radius of curvature is less than 0.6 mm, a convex dent generated on the outer surface of each leg of the stopper would be noticeable and might impair the appearance of the stopper.

In one embodiment of the present invention, the depth of the recess is 0.02 mm or more and 0.1 mm or less. Further, in one embodiment of the present invention, the length of the recess in the longitudinal direction is 0.512 mm or more and 1.294 mm or less.

According to another aspect of the present invention, a method for manufacturing a stopper for a slide fastener; comprising the steps of A: in a metal stopper comprising a head and a pair of legs extending from the head in a bifurcated manner, forming a recess in the center on an inner surface of each of the legs; and B: after the step A, putting a number of the stoppers in a container and then coating the stoppers while moving the container. In one embodiment of the present invention, the ratio of the depth of the recess to the thickness of each leg of the stopper is 3.8% or more and 18.9% or less.

Advantageous Effects of Invention

In the present invention, by providing a recess in the center on the inner surface of each leg of the stopper, and setting the ratio of the depth of the recess to the thickness of the leg of the stopper to 3.8% or more and 18.9% or less, even if two stoppers overlap during the coating process of stoppers, it is possible to reduce an adhesive area between the two stoppers. Thereby, it is possible to reduce the rate of stoppers becoming defective because both stoppers adhere to each other or uncoated portions occur with contacting portions peeling off.

BRIEF DESCRIPTION OF DRAWINGS

FIG. 1 is a plan view showing a slide fastener cut away in its longitudinal direction, including a stopper according to the present invention.

FIG. 2 is a cross-sectional view of a fastener tape with an upper stopper attached to an opposite edge of the tape.

FIG. 3 is a perspective view showing the upper stopper before it is attached to the fastener tape.

FIG. 4 is a cross-sectional view of the upper stopper along the midpoint in the longitudinal direction of the upper stopper.

FIG. 5 shows a cross-section (a cross-section along the longitudinal direction) of a recess along line S-S in FIG. 3.

FIG. 6 is an enlarged view of the recess in FIG. 4, and is a cross-section taken along the lateral direction of the recess.

FIG. 7 is a front view showing two stoppers overlapping during the painting process.

DESCRIPTION OF EMBODIMENTS

Hereinafter, embodiments of a stopper for a slide fastener according to the present invention will be described based on the drawings, but the present invention is not limited to such embodiments. FIG. 1 is a plan view showing a slide fastener 1 that is cut away in its longitudinal direction. The slide fastener 1 includes two upper stoppers 10, which are an embodiment of a stopper for a slide fastener of the present invention. In this embodiment, the upper stoppers 10 are made of aluminum alloy, but not limited thereto.

The slide fastener 1 comprises a pair of left and right fastener stringers 2, 2, and a slider 3 that a user slides to open and close between the left and right fastener stringers 2, 2. The slider 3 has a pull 3*a* that is held by a user. Each fastener stringer 2 includes a band-shaped fastener tape 4 and an element row 5 comprising a large number of metal elements 5*a* provided along an opposite edge (an edge on the side facing the other fastener tape 4) in the width direction of the fastener tape 4. Each of the left and right upper stoppers 10, 10 is attached to the opposite edge of each fastener tape 4 so as to be adjacent to the upper end of each element row 5. A core string 6 is incorporated into the opposite edge of each fastener tape 4, thereby making the opposite edge thick. FIG. 2 is a cross-sectional view of the fastener tape 4 with the upper stopper 10 attached to the opposite edge. The upper stopper 10 and element 5*a* are crimped to the fastener tape 4 so as to enclose the core cord 6, thereby increasing the attachment strength of the upper stopper 10 and element 5*a*. In the slide fastener 1, when a user slides the slider 3 upward, the element rows 5, 5 of the left and right fastener stringers 2, 2 close, and when a user slides the slider 3 downward, the left and right element rows 5, 5 close. The upper stopper 10 limits the upward movement of the slider 3. The slide fastener 1 includes a lower stopper 7 that limits the downward movement of the slider 3. The lower stopper 7 is attached across the lower ends of the left and right element rows 5, 5.

FIG. 3 is a perspective view showing the upper stopper 10 in a state before it is attached to the fastener tape 4. The upper stopper 10 in FIG. 3 is one after the coating process. FIG. 4 is the cross-sectional view of the upper stopper 10 along the midpoint in the longitudinal direction LD (see FIG. 3) of the upper stopper 10. Hereinafter, for convenience of explanation, the upper, lower, left and right sides of the upper stopper 10 are based on the paper plane of FIG. 4. The upper stopper 10 comprises a head 11 and left and right legs 12, 12 extending downward from the head 11 in a bifurcated manner. The upper stopper 10 has two end surfaces 10*a*, 10*a* (see FIG. 3) in the longitudinal direction LD. Each end surface 10*a* is parallel to each other. Let the length of the stopper 10 in the longitudinal direction LD be L1. L1 is the distance between both end surfaces 10*a*. 10*a*. The two legs 12, 12 expand downward from the head 11 in a substantially V-shaped cross-section. Each leg 12 is a substantially plate-shaped portion and has an outer surface 12*a* and an inner surface 12*b*. The inner surfaces 12*b* of the left and right legs 12 are connected to each other at the midpoint in the left-and-right direction (see imaginary line M in FIG. 3). In other words, the imaginary line M is the boundary between the left and right inner surfaces 12*b*. In the center on the inner surface 12*b* of each leg 12, one recess 20 is provided, which is recessed from the inner surface 12*b*. As will be described later, the recess 20 is formed before the coating process of the upper stopper 10. The recess 20 has a substantially elliptical shape that is long in the longitudinal direction LD of the upper stopper 10 on the inner surface 12*b*. The long axis of the recess 20 is along the longitudinal direction LD, and the short axis of the recess 20 is along the lateral direction (the direction perpendicular to the longitudinal direction, and the leg main body 13 described later expands in the lateral direction). Further, the longitudinal direction LD coincides with the longitudinal direction of the fastener tape 4 to which the upper stopper 10 is attached.

Referring to FIG. 4, the head 11 of the upper stopper 10 has a substantially horizontal top surface 11*a* and left and right substantially vertical side surfaces 11*b*, 11*b*. Further, the upper stopper 10 includes head corner portions 11*c* between the top surface 11*a* and the left and right side surfaces 11*b*, respectively. Each head corner portion 11*c* defines a convex curved surface 11*d* that gently connects between the top surface 11*a* and each side surface 11*b*. It is preferable that the radius of curvature of the head corner portion 11*c* is set larger than the radius of curvature R2 (see FIG. 6) of the corner portion 22 in the cross-section along the lateral direction of the recess 20, which will be described later. The leg 12 includes a leg main body 13 extending downward and obliquely from the head 11 and a leg end portion 14 extending downward and substantially vertically from the lower end of the leg main body 13. The recess 20 is provided on the inner surface 12*b* of the leg 12 so as to include the midpoint in the longitudinal direction and the midpoint in the lateral direction of the leg main body 13. The outer surface 14*a* and the inner surface 14*b* of each leg end portion 14 are substantially parallel to the left and right sides 11*b*, 11*b* of the head 11. Referring to FIG. 2, in a state where the upper stopper 10 is crimped to the fastener tape 4, both leg main bodies 13 approach parallel to each other on the front and back sides of the fastener tape 4, and both leg end portions 14 compress the front and back sides of the fastener tape 4.

FIG. 5 shows the cross-section of the recess 20 along line S-S in FIG. 3. FIG. 5 is the cross-section of the recess 20 along its long axis, namely the longitudinal direction. On the other hand, the cross-section of the recess 20 shown in FIG. 4 is along its short axis (lateral direction). FIG. 6 is an enlarged view of the recess 20 in FIG. 4, and is the cross-section of the recess 20 along the lateral direction. The recess 20 includes a bottom portion 21 which is the deepest from the inner surface 12*b* of the leg 12, and two corner portions 22, which become shallower from the bottom portion 21 to the inner surface 12*b*. The bottom portion 21 is relatively long in the longitudinal direction of the recess 20 (see FIG. 5) and short in the lateral direction of the recess 20 (see FIG. 6). The cross-sectional shape of the recess 20 in the lateral direction is substantially arcuate due to the two adjacent corner portions 22.

To manufacture the upper stopper 10, first, a long wire made of aluminum alloy and having a circular cross-section, which is a raw material for the upper stopper 10, is rolled into a V-shaped cross-sectional wire. This cross-section is substantially the cross-section of the upper stopper 10. Next, the recess 20 is formed on the inner surface of the V-shaped cross-section wire at predetermined intervals in the longitudinal direction using a concave mold (step A). Next, the wire is cut in the longitudinal direction to obtain a large number of upper stoppers 10 before painting. The end surfaces 10*a* of the upper stopper 10 are a cut surface of the wire. Next, a large number of upper stoppers 10 are coated (Step B). In this coating process, a large number of upper stoppers 10 are housed in a barrel container, and a coating is sprayed onto the upper stoppers 10 from outside the barrel container while the barrel container is rotated. After that the upper stoppers 10 are dried. These painting and drying processes are repeated several times. Thereafter, the upper stoppers 10 are attached to the fastener tape 4. When the upper stopper 10 is attached to the fastener tape 4, the opposite edge (core string 6) of the fastener tape 4 is placed between the two legs 12 of the upper stopper 10, and then the upper stopper 1 are crimped so as to close both legs 12 using a mold. Thereby, the upper stopper 10 is fixed to the fastener tape 4 as shown in FIG. 2.

In the above painting process, there is a case where two of the many upper stoppers 10 that are moving randomly within the barrel container overlap each other. FIG. 7 is a front view showing two identical upper stoppers 10, 10A, 10B, which are overlapped during the painting process. In FIG. 7, the head 11A of one upper stopper 10A comes in between the two legs 12B of the other upper stopper 10B and the upper stoppers 10A. 10B are stacked. At this time, the two head corner portions 11*c* of the head 11A of the upper stopper 10A are in contact with the inner surfaces 12*b* of the two legs 12B of the upper stopper 10B. However, it is possible to reduce the contact area between the upper stoppers 10A, 10B by the recesses 20 provided in the inner surface 12*b* of each leg 12B of the upper stopper 10B. Thereby, it is possible to reduce a rate of the upper stopper 10 becoming defective. Defective upper stoppers may occur for reasons that both upper stoppers 10A. 10B adhere to each other through the coating on their contacting portions or uncoated portions occur because the contacting portions peel off during or after the painting process.

Referring to FIG. 5, let the thickness of the leg 12 be "E" and the depth of the recess 20 be "D". The thickness E of the leg 12 is the distance between the outer surface 12*a* and the inner surface 12*b* of the leg 12. Further, the depth D of the recess 20 is the distance between the inner surface 12*b* and the bottom portion 21 of the recess 20. In this embodiment, the ratio D/E, namely a percentage of the depth D of the recess 20 to the thickness E of the leg 12 is set to 3.8% or more and 18.9% or less. This reduces the contact area between the two upper stoppers 10A, 10B during the painting process, and prevents the two upper stoppers 10A, 10B from adhering to each other through the coating on the contact portions or prevents uncoated portions from occurring because the contacting portions peel off. When the ratio D/E was less than 3.8%, it did not significantly contribute to reducing the adhesion between the two upper stoppers 10A, 10B during the coating process. In addition, when the recess 20 with the ratio D/E exceeding 18.8% was molded using a concave mold, a convex dent was noticeable, which was generated at a portion corresponding to the recess 20, on the outer surface 12*a* of each leg 12 in the upper stopper 10, spoiling the appearance of the upper stopper 10.

Furthermore, in the upper stopper 10, the radius of curvature R1 of the corner portion 22 of the recess 20 in the cross-section along the longitudinal direction is set to 0.6 mm or more. Even when the corner portion 22 was molded so that the radius of curvature R1 was less than 0.6 mm, a convex dent generated in a portion corresponding to the recess 20 on the outer surface 12*a* of the leg 12 was noticeable, and the appearance of the upper stopper 10 was deteriorated. Similarly, it is desirable that the radius of curvature R2 of the corner portion 22 in the cross-section along the transverse direction of the recess 20 is also set to 0.6 mm or more.

TABLE 1

※1 lot for coating process = 5,000 g (about 125,000 stops)

| | comparative example | Example 1 | Example 2 | Example 3 | Example 4 | Example 5 | Example 6 |
|---|---|---|---|---|---|---|---|
| Depth of recess D(mm) | no recess | 0.03 mm | 0.06 mm | 0.10 mm | 0.02 mm | 0.04 mm | 0.10 mm |
| D/E (%): Thickness of leg E(0.53 mm) | | 5.7% | 11.3% | 18.9% | 3.8% | 7.5% | 18.9% |
| R of recess included or not included | R not included | R not included | | | 0.6 mm R1 and R2 added | | |
| adhesion defective rate (%) | 1.25% | 0.13% | 0.07% | 0.07% | 0.56% | 0.42% | 0.79% |
| adhesion peel defective rate (%) | 0.08% | 0.01% | 0.01% | 0.01% | 0.01% | 0.03% | 0.02% |

Table 1 shows, with regard to Examples 1 to 6, which are the upper stopper 10 according to the present invention, and a comparative example, which is a stopper with the same dimensions as the upper stopper 10 but without a recess, the results of measuring the following rates. That is, the rate at which two stoppers adhere to each other during the painting process (adhesion defective rate), and after that the rate at which the adhesion peels off and becomes defective (adhesion peel defective rate), respectively, in stoppers of 500 grams for one lot (about 125,000 stoppers). In this case, the dimensions of the upper stopper 10 are as follows. The length L1 (see FIG. 3) of the upper stopper 10 in the longitudinal direction is 3.80 mm to 4.00 mm. The length L2 (see FIG. 5) of the recess 20 in the longitudinal direction is 0.512 mm to 1.294 mm. The ratio of the length L2 of the recess 20 in the longitudinal direction to the length L1 of the upper stopper 10 in the longitudinal direction is 13.5% to 23.5%. The thickness E of the leg 12 of the upper stopper 10 is 0.53 mm. The depth D of the recess 20 is 0.03 mm in Example 1; 0.06 mm in Example 2; 0.10 mm in Example 3; 0.02 mm in Example 4; 0.04 mm in Example 5; and 0.10 mm in Example 6. The ratio D/E of the depth D of the recess 20 to the thickness E of the leg 12 of the upper stopper 10 is 5.7% in Example 1; 11.3% in Example 2; 18.9% in Example 3; 3.8% in Example 4; 7.5% in Example 5; and 18.9% in Example 2. Furthermore, the radii of curvature R1 and R2 of the corner portion 22 of the recess 20 in the longitudinal direction and the lateral direction are 0.6 mm in Examples 4 to 6, but there are no radii of curvature in Examples 1 to 3. Further, the volume of the recess 20 is 0.002 $mm^3$ to 0.058 $mm^3$. As can be seen from Table 1, compared to the comparative example without a recess, the upper stopper 10 having the recess 20 in Examples 1 to 6 has a significantly lower adhesion failure rate and correspondingly lower adhesion peel defective rate.

TABLE 2

| | R1 | R2 | Depth of recess D | Length of recess L2 | volume of recess | appearance of stop | press moldability | adhesion failure |
|---|---|---|---|---|---|---|---|---|
| Example 7 | 0.6 mm | 0.0 mm | 0.100 mm | 1.294 mm | 0.058 $mm^3$ | x | ○ | ○ |
| Example 8 | 0.6 mm | 0.0 mm | 0.060 mm | 1.214 mm | 0.026 $mm^3$ | x | ○ | ○ |
| Example 9 | 0.6 mm | 0.0 mm | 0.030 mm | 1.150 mm | 0.009 $mm^3$ | x | ○ | ○ |
| Example 10 | 0.6 mm | 0.6 mm | 0.100 mm | 0.892 mm | 0.057 $mm^3$ | ○ | ○ | ○ |
| Example 11 | 0.6 mm | 0.6 mm | 0.040 mm | 0.702 mm | 0.010 $mm^3$ | ○ | ○ | ○ |
| Example 12 | 0.6 mm | 0.6 mm | 0.020 mm | 0.512 mm | 0.002 $mm^3$ | ○ | ○ | ○ |

Table 2 shows Examples 7 to 12 of the upper stopper 10 according to the present invention, in which the radii of curvature R1 and R2 of the corner portion 22 of the recess 20, the longitudinal length L2 of the recess 20 and the volume of the recess 20 are changed. Then, the appearance of the outer surface 12*a* side of the leg 12 of the upper stopper 10, the press moldability of forming the recess 20 in the upper stopper 10, and whether or not two upper stoppers 10 are hard to adhere to each other during the painting process were observed. In Examples 7 to 9 in which R1 is 0.0 mm, a convex dent generated on the outer surface 12*a* of the leg 12 of the upper stopper 10 was noticeable, spoiling the appearance of the upper stopper 10. In Examples 10 to 12 in which R1 and R2 are both 0.6 mm, such a convex dent was not noticeable. Further, in Examples 7 to 12, the press moldability was good, and almost no adhesion failure occurred.

DESCRIPTION OF REFERENCE NUMERALS

1 slide fastener
2 fastener stringer
3 slider
4 fastener tape
5 element row
6 core string
10, 10A, 10B upper stopper (stopper)
11 head
11*c* head corner portions
12 legs
12*a* outer surface of leg
12*b* inner surface of leg
20 recess
21 bottom portion
22 corner portion
D depth of recess
E thickness of leg
L1 longitudinal length of stopper
L2 longitudinal length of recess
R1 radius of curvature in longitudinal direction of corner portion of recess
R2 radius of curvature in lateral direction of corner portion of recess

What is claimed is:

1. A coated metal stopper (10) for a slide fastener, comprising:

a head (11) and a pair of legs (12) extending downward from the head (11) in a bifurcated manner, wherein each of the legs (12) has a recess (20) in a center on its inner surface (12*b*); and wherein a ratio of a depth (D) of the recess (20) to a thickness (E) of said each of the legs (12) of the stopper (10) is 3.8% or more and 18.9% or less, wherein said each of the legs (12) includes a leg main body (13) extending downward and obliquely from the head (11) and a leg end portion (14) extending downward and vertically from a lower end of the leg main body (13), and wherein the recess (20) is provided on the inner surface (12*b*) of said each of the legs (12) so as to include a midpoint in a longitudinal direction of the leg main body (13) and a midpoint in a lateral direction of the leg main body (13).

2. The stopper for the slide fastener according to claim 1, wherein a ratio of a length (L2) of the recess (20) in a longitudinal direction of the stopper (10) to a length (L1) of the stopper (10) in the longitudinal direction of the stopper (10) is 13.5% or more and 23.5% or less.

3. The stopper for the slide fastener according to claim 1, wherein the recess (20) includes, in a cross-section along a longitudinal direction of the stopper (10), a bottom portion (21), which is deepest from the inner surface (12*b*) and two corner portions (22), each of which is concave, curved surface becoming shallower from the bottom portion (21) to the inner surface (12*b*), and wherein a radius of curvature of each corner portion (22) is 0.6 mm or more.

4. The stopper for the slide fastener according to claim 3, wherein the recess (20) includes, in a cross-section along a transverse direction of the stopper (10), the bottom portion (21), which is deepest from the inner surface (12*b*) and the two corner portions (22), each of which is concave, curved surface becoming shallower from the bottom portion (21) to the inner surface (12*b*), and wherein the radius of curvature of the each corner portion (22) is 0.6 mm or more.

5. The stopper for the slide fastener according to claim 1, wherein the depth (D) of the recess (20) is 0.02 mm or more and 0.1 mm or less.

6. The stopper for the slide fastener according to claim 1, wherein a length (L2) of the recess (20) in a longitudinal direction of the recess is 0.512 mm or more and 1.294 mm or less.

7. A method for manufacturing a stopper for a slide fastener; comprising steps of:

A: in a metal stopper (10) comprising a head (11) and a pair of legs (12) extending downward from the head (11) in a bifurcated manner, forming a recess (20) in a center on an inner surface (12*b*) of each of the legs (12); and B: after the step A, putting a number of stoppers (10), each including the stopper, in a container and then coating the stoppers (10) while moving the container, wherein a ratio of a depth (D) of the recess (20) to a thickness (E) of said each of the legs (12) of the stopper (10) is 3.8% or more and 18.9% or less, wherein said each of the legs (12) includes a leg main body (13) extending downward and obliquely from the head (11) and a leg end portion (14) extending downward and vertically from a lower end of the leg main body (13), and wherein the recess (20) is provided on the inner surface (12*b*) of said each of the legs (12) so as to include a midpoint in a longitudinal direction of the leg main body (13) and a midpoint in a lateral direction of the leg main body (13).

8. The method for manufacturing the stopper for the slide fastener according to claim 7, wherein a ratio of a length (L2) of the recess (20) in a longitudinal direction of the stopper (10) to a length (L1) of the stopper (10) in the longitudinal direction of the stopper is 13.5% or more and 23.5% or less.

* * * * *